US008986044B2

(12) United States Patent
Meister et al.

(10) Patent No.: US 8,986,044 B2
(45) Date of Patent: Mar. 24, 2015

(54) QUICK MOUNT CONNECTOR FOR A COAXIAL CABLE

(71) Applicants: Michael Meister, Langebaek (DK); Jens Petersen, Vordingborg (DK)

(72) Inventors: Michael Meister, Langebaek (DK); Jens Petersen, Vordingborg (DK)

(73) Assignee: Corning Gilbert Inc., Hickory, NC (US)

( * ) Notice: Subject to any disclaimer, the term of this patent is extended or adjusted under 35 U.S.C. 154(b) by 66 days.

(21) Appl. No.: 13/795,843

(22) Filed: Mar. 12, 2013

(65) Prior Publication Data

US 2014/0120766 A1 May 1, 2014

Related U.S. Application Data

(60) Provisional application No. 61/719,106, filed on Oct. 26, 2012, provisional application No. 61/728,484, filed on Nov. 20, 2012.

(51) Int. Cl.
*H01R 9/05* (2006.01)
*H01R 13/502* (2006.01)

(52) U.S. Cl.
CPC ..... *H01R 9/0503* (2013.01); *H01R 9/0524* (2013.01); *H01R 13/502* (2013.01)
USPC ..... 439/578

(58) Field of Classification Search
USPC ..... 439/578, 584, 394
See application file for complete search history.

(56) References Cited

U.S. PATENT DOCUMENTS

| | | | | |
|---|---|---|---|---|
| 589,216 | A | 8/1897 | McKee | |
| 2,785,384 | A | 3/1957 | Wickesser | 339/94 |
| 3,336,563 | A | 8/1967 | Hyslop | 339/61 |
| 3,537,065 | A | 10/1970 | Winston | 339/177 |
| 3,706,958 | A | 12/1972 | Blanchenot | 339/177 E |
| 3,846,738 | A | 11/1974 | Nepovim | 339/177 R |
| 4,666,190 | A | 5/1987 | Yamabe et al. | 285/93 |
| 4,834,676 | A | 5/1989 | Tackett | 439/584 |
| 5,024,606 | A | 6/1991 | Ming-Hwa | 439/578 |
| 5,059,139 | A | 10/1991 | Spinner | 439/583 |
| 5,195,906 | A | 3/1993 | Szegda | 439/394 |
| 5,393,244 | A | 2/1995 | Szegda | 439/394 |
| 5,466,173 | A | 11/1995 | Down | 439/584 |
| 5,525,076 | A | 6/1996 | Down | 439/585 |

(Continued)

FOREIGN PATENT DOCUMENTS

WO WO2011/057033 A1 5/2011 ..... H01R 9/05

OTHER PUBLICATIONS

Patent Cooperation Treaty, International Search Report for PCT/US2013/065860, Dec. 12, 2013, 9 pages.

*Primary Examiner* — Phuong Dinh
(74) *Attorney, Agent, or Firm* — Harness, Dickey & Pierce, PLC

(57) ABSTRACT

A coaxial cable connector comprising a coupler, a body, a shell, a ferrule, and a compression ring is disclosed. The ferrule is disposed adjacent to the body and has a plurality of fingers with inwardly directed barbs and a channel with a wall having an inwardly facing surface with inner projections. The compression ring is disposed within the shell and engages the rear end of the ferrule. Advancing the shell toward the coupler causes the compression ring to drive the rear portion of the ferrule inwardly. This causes the plurality of fingers to flex inwardly toward the coaxial cable forcing the barbs against the coaxial cable. This also causes the compression ring to provide a biasing force against the channel forcing the inner projections of the inwardly facing surface of the wall to bite into the coaxial cable.

23 Claims, 7 Drawing Sheets

(56) References Cited

U.S. PATENT DOCUMENTS

| | | | | |
|---|---|---|---|---|
| 6,042,422 | A | 3/2000 | Youtsey | 439/585 |
| 6,089,912 | A | 7/2000 | Tallis et al. | 439/584 |
| 6,331,123 | B1 | 12/2001 | Rodrigues | 439/584 |
| 6,558,194 | B2 | 5/2003 | Montena | 439/585 |
| 6,683,253 | B1 | 1/2004 | Lee | 174/75 C |
| 6,805,584 | B1 | 10/2004 | Chen | 439/578 |
| 6,848,939 | B2 | 2/2005 | Stirling | 439/578 |
| 7,112,093 | B1 | 9/2006 | Holland | 439/585 |
| 7,347,729 | B2 | 3/2008 | Thomas et al. | 439/583 |
| 7,351,101 | B1 | 4/2008 | Montena | 439/584 |
| 7,507,116 | B2 | 3/2009 | Laerke et al. | 439/584 |
| 7,942,695 | B1 | 5/2011 | Lu | 439/578 |
| 8,011,955 | B1 | 9/2011 | Lu | 439/585 |
| 2007/0093128 | A1* | 4/2007 | Thomas et al. | 439/578 |
| 2008/0194143 | A1 | 8/2008 | Holliday | 439/584 |
| 2008/0261445 | A1* | 10/2008 | Malloy et al. | 439/578 |
| 2010/0112856 | A1* | 5/2010 | Paynter et al. | 439/584 |
| 2012/0064764 | A1* | 3/2012 | Islam | 439/578 |

* cited by examiner

-- PRIOR ART --

-- PRIOR ART --

-- PRIOR ART --

QUICK MOUNT CONNECTOR FOR A COAXIAL CABLE

RELATED APPLICATIONS

This application claims the benefit of priority under 35 U.S.C. §119 of U.S. Provisional Application Ser. No. 61/719,106 filed on Oct. 26, 2012 the content of which is relied upon and incorporated herein by reference in its entirety.

This application claims the benefit of priority under 35 U.S.C. §119 of U.S. Provisional Application Ser. No. 61/728,484 filed on Nov. 20, 2012 the content of which is relied upon and incorporated herein by reference in its entirety.

This application is related to U.S. Application No. 61/583,385, filed Jan. 5, 2012, which is incorporated herein by reference in its entirety.

BACKGROUND

1. Field of the Disclosure

The disclosure relates generally to coaxial cable connectors, and particularly to quick mount Type F connectors for use with minimally prepared coaxial cables.

2. Technical Background

Coaxial cable connectors such as F-connectors are used to attach coaxial cables to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath). The conductive grounding sheath is itself surrounded by a protective outer jacket (FIG. 1). The F-connector is typically secured over the prepared end of the jacketed coaxial cable, allowing the end of the coaxial cable to be connected with a terminal block, such as by a threaded connection with a threaded terminal of a terminal block.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for allowing such compression sleeve to be passed over the end of the coaxial cable prior to installation of the F-connector. The end of the coaxial cable must be prepared by removing a portion of the outer braid and/or folding the outer braid back over the cable jacket. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and a tubular post of the connector. An example of such a compression sleeve F-connector is shown in U.S. Pat. No. 4,834,675 to Samchisen A number of commercial tool manufacturers provide compression tools for axially compressing the compression sleeve into such connectors.

Referring to FIGS. 1, 1A, and 1B, a coaxial cable 100 is illustrated and the method in which the end of the coaxial cable 100 is prepared. Referring to FIG. 1, the coaxial cable 100 has a center conductor 102 that is surrounded by a dielectric layer 104. The dielectric layer (or dielectric) 104 may also have a foil or other metallic covering 106. Coaxial cable 100 then has a braided outer conductor 108 which is covered and protected by a jacket 110. Typically, to prepare the coaxial cable 100 for attachment to a coaxial cable connector, a portion of the center conductor 102 is exposed as illustrated in FIG. 1A. The jacket 110 is trimmed back so that a portion of the dielectric 104 (and metallic covering 106) and braided outer conductor 108 are exposed. The braided outer conductor 108 is then folded back over the jacket 110, to expose the dielectric (and the metallic covering 106 if present).

FIG. 1B illustrates the coaxial cable of FIG. 1A with an end prepared for insertion into coaxial connector 10. The connector 10 has a coupler 11 beyond which the center conductor 102 extends and is attached to a body 13. A post 12 used to secure the coaxial cable 100 relative to the coaxial connector 10 is positioned inside body 13. As can be seen in FIG. 1B, the post 12 is inserted into cable 100 between the braided outer conductor 108 and dielectric 104. The post 12 can cause problems for the coaxial connector 10 as well as the installer. In addition to an installer having to prepare the end of the coaxial cable 100, which requires time and effort, the post 12 can skive the coaxial cable 100, tearing the braided outer conductor 108 or the jacket 110. Additionally, it can be difficult to insert the post 12 into the coaxial cable 100.

It is known in the coaxial cable field, generally, that collars or sleeves within a coaxial cable connector can be compressed inwardly against the outer surface of a coaxial cable to secure a coaxial cable connector thereto. For example, in U.S. Pat. No. 4,575,274 to Hayward, a connector assembly for a signal transmission system is disclosed wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, the connector shown in the Hayward '274 patent can not be installed quickly, as by a simple crimp or compression tool. Rather, the mating threads of such connector must be tightened, as by using a pair of wrenches. Additionally, the end of the coaxial cable must be prepared by stripping back the outer jacket and the conductive grounding sheath, all of which takes time, tools, and patience.

SUMMARY OF THE DETAILED DESCRIPTION

Embodiments disclosed herein include a coaxial cable connector for coupling an end of a coaxial cable to a terminal. The coaxial cable has an inner conductor, a dielectric surrounding the inner conductor, an outer conductor surrounding the dielectric, and a jacket surrounding the outer conductor. The coaxial cable connector may comprise a coupler, a body, a shell, a ferrule, and a compression ring. The body may have an internal surface extending between front and rear ends of the body. The internal surface defines a longitudinal opening. The body may be rotatably attached to the coupler. The shell may have an outer surface and an internal surface, the internal surface defining an opening through the shell. The internal surface of the shell may slidingly engage at least a portion of the rear end of the body. The ferrule may be disposed adjacent to the body and have a plurality of fingers with inwardly directed engagement features, such as barbs, and a channel with a wall having an inwardly facing surface with inner projections. The compression ring may be disposed within the shell and may engage the rear end of the ferrule. The compression ring may have an internal surface. Advancing the shell toward the coupler may cause the compression ring to drive the rear portion of the ferrule inwardly. This may cause the plurality of fingers to flex inwardly toward the coaxial cable forcing the engagement features against the coaxial cable. This also may cause the compression ring to provide a biasing force against the channel forcing the inner projections of the inwardly facing surface of the wall to bite into the coaxial cable.

The coaxial cable connector may also comprise a retainer a contact and an insulator. The retainer may seat in a retainer channel in the body. The retainer provides a biasing force to rotatably attach the body to the coupler. The contact may have an attachment portion, adapted to retain and be mechanically connected to and be electrically continuous with the inner conductor of the coaxial cable. The insulator may position around the contact and friction fit to the internal surface of the body.

Additional features and advantages are set out in the detailed description which follows, and in part will be readily apparent to those skilled in the art from that description or recognized by practicing the embodiments as described herein, including the detailed description, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Whenever possible, like reference numbers will be used to refer to like components or parts.

Embodiments disclosed herein include a coaxial cable connector for coupling an end of a coaxial cable to a terminal. The coaxial cable has an inner conductor, a dielectric surrounding the inner conductor, an outer conductor surrounding the dielectric, and a jacket surrounding the outer conductor. In various embodiments, the coaxial cable connector may comprise, for example, a coupler, a body, a shell, a ferrule, and a compression ring. The body may have an internal surface extending between front and rear ends of the body, with the internal surface defining a longitudinal opening. The body may also advantageously be rotatably attached to the coupler, with the shell having an outer surface, and an internal surface defining an opening through the shell. The internal surface of the shell may slidingly engage at least a portion of the body, and with the ferrule being disposed adjacent to the body and comprising one of more fingers with inwardly directed engagement features, such as, for example, barbs, and a channel with a wall having an inwardly facing surface with inner projections. The compression ring may have an internal surface and be disposed within the shell for engaging the rear end of the ferrule.

The coaxial cable connector may also comprise a retainer a contact and an insulator. The retainer may seat in a retainer channel in the body. The retainer provides a biasing force to rotatably attach the body to the coupler. The contact may have an attachment portion, adapted to retain and be mechanically connected to and be electrically continuous with the inner conductor of the coaxial cable. The insulator may position around the contact and friction fit to the internal surface of the body.

Figure 1:
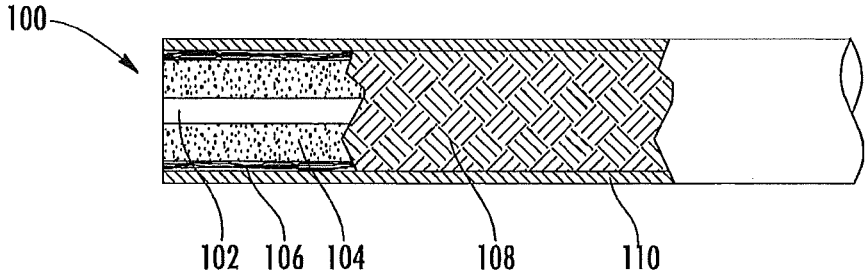
FIG. 1 is a partial cross section of a coaxial cable as is known in the prior art.
Figure 1A:
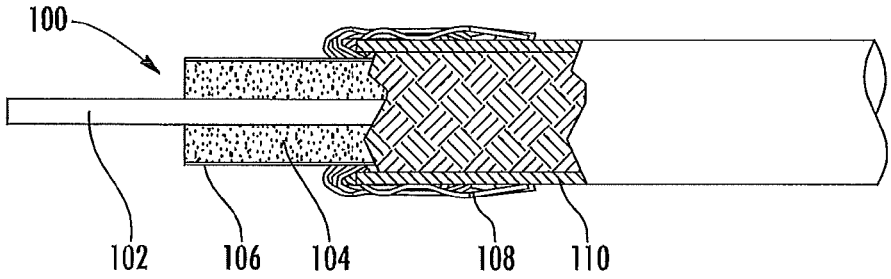
FIG. 1A is a partial cross section of the coaxial cable of FIG. 1 with the end prepared for installation in a coaxial cable connector.
Figure 1B:
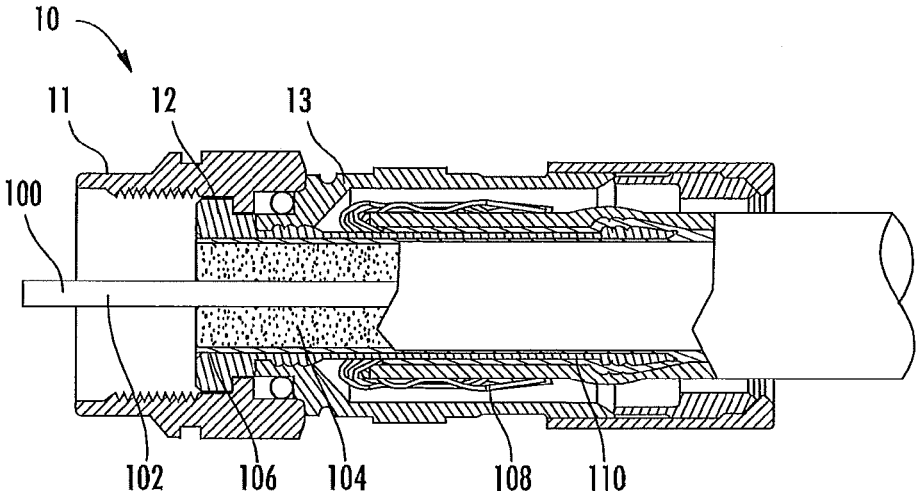
FIG. 1B is a partial cross section of a prior art coaxial connector with a coaxial cable prepared as shown in FIG. 1A installed therein.
Figure 2:
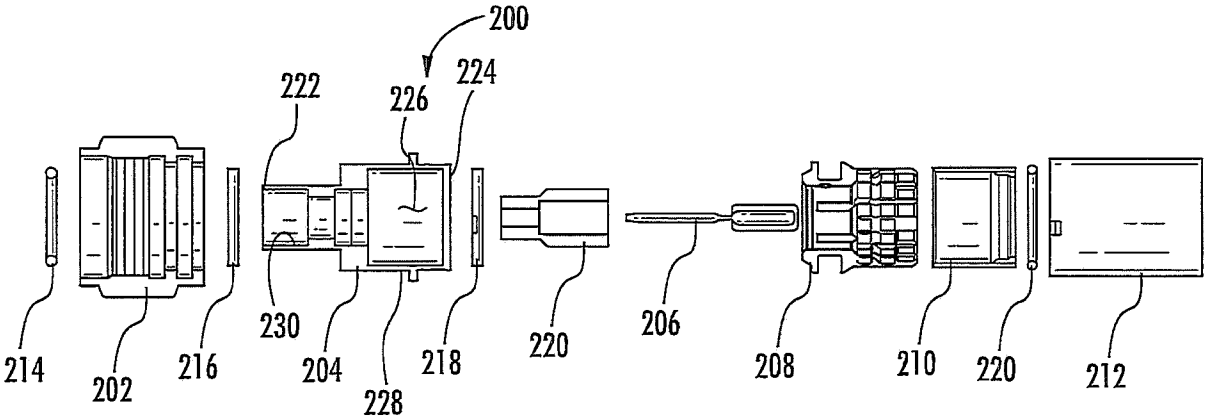
FIG. 2 is an exploded, perspective view of an exemplary embodiment of a coaxial connector.
Figure 3:
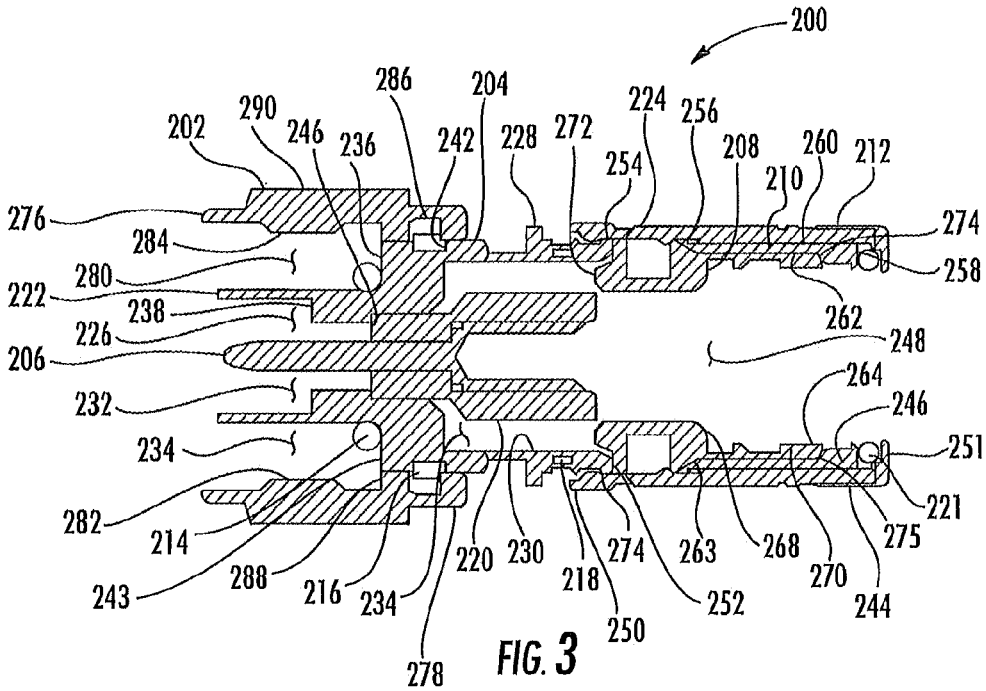
FIG. 3 is a cross sectional view of the assembled coaxial cable connector of FIG. 2.

Referring now FIGS. 2 and 3, there is shown a coaxial cable connector 200. FIG. 2 is an exploded, cross sectional view, while FIG. 3 is an assembled cross sectional view. Both views illustrate coaxial cable connector 200 unengaged or, in other words, without a coaxial cable inserted therein. Coaxial cable connector 200 has coupler 202, body 204, contact 206, ferrule 208, compression ring 210, shell 212, O-ring 214, retainer 216, seal 218, insulator 220, and O-ring 221.

Body 204 extends between front end 222 and rear end 224 defining longitudinal opening 226. Body 204 also has outer surface 228 and inner surface 230. Inner surface 230 includes first bore 232 and second bore 234. Insulator 220 positions around contact 206 and press or friction fits to body 204 at inner surface 230 at thickened wall portion 236 of inner surface 230. Thickened wall portion 236 along with annular projection 238 separates first bore 232 from second bore 234. Rearward face 240 of annular projection 238 provides a stop for insulator 220. Retainer 216 seats in retainer channel 242 of body 204 and provides a biasing force to rotatably attach and secure body 204 to coupler 202.

Shell 212 has outer surface 244 and internal surface 246 defining opening 248 therethrough. Shell 212 has a front end 250 and rear end 251. Annular ring 252 engages and is retained on body 204 by annular projection 254. In this manner, shell 212 is slidably connected to body 204. Shell 204 may be made from brass, or any other appropriate material.

Compression ring 210 is disposed within opening 248 of shell 212. Compression ring 210 has front end 256 and rear end 258, outer surface 260 and internal surface 262. Front end 256 has tapered surface 263. Outer surface 260 of compression ring 210 is disposed against internal surface 246 of shell 212. Compression ring 210 has tapered surface 264 proximate rear end 258. O-ring 221 positions between rear end 258 of compression ring 210 and rear end 251 of shell 212 within opening 248. O-ring 221 provides for environmental protection of coaxial connector 200 at shell 212 when coaxial cable is inserted into shell 212 as described below.

Ferrule 208 has front portion 268 and rear portion 270 and is disposed within opening 248 of shell 212. Ferrule 208 has front end 272 which may be disposed against rear end 224 of body 204 and rear end 274. Rear end 274 has tapered surface 275 to match and position against tapered surface 264 of compression ring 210. Additionally, a portion of front portion 268 and rear portion 270 may be disposed within and against internal surface 262 of compression ring 210.

Coupler 202 has front end 276, back end 278, and opening 280 extending therebetween. Opening 280 of coupling portion 202 has internal surface 282. Internal surface 282 includes threaded portion 284. Coupler 202 has inwardly lip 288 which rotatably meets body 204 at thickened wall portion 236. Coupler 202 has smooth outer surface 290 adjacent front end 276 and may have hexagonal configuration adjacent back end 278. Coupler 202 may be made from a metallic material, such as brass, and may be plated with a conductive, corrosion-resistant material, such as nickel, but it may be made from any appropriate material. Opening 280 receives O-ring 214, which locates around body 204 proximate first end 222 of body 204 at forward face 241 of thickened wall portion 236. O-ring 214 provides for environmental protection of coaxial connector 200 at coupler 202 when the coupler 202 is connected to an equipment port (not shown).

Figure 4:
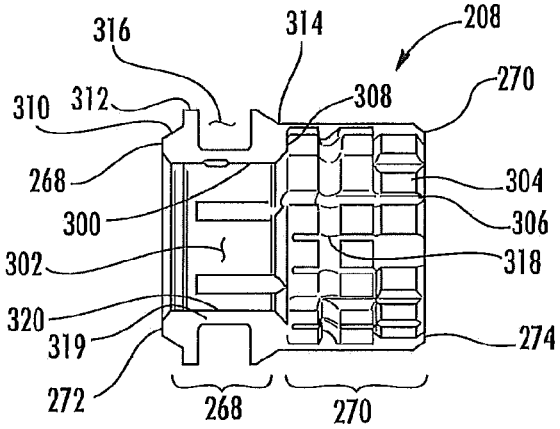
FIG. 4 is a detail, cross sectional view of an exemplary embodiment of a ferrule in coaxial cable connector of FIGS. 2 and 3.

Referring now to FIG. 4, a detail cross section of ferrule 208 is illustrated. Front portion 268 has wall 300 defining passage 302 which extends from front end 272 to rear portion 270. Rear portion 270 has at least one finger and may in some embodiments comprise a plurality of fingers 304 extending circumferentially around rear portion 270. Fingers 304 are defined by longitudinal slots 306 extending from rear end 274 of ferrule 208 through rear portion 270 and partially into front portion 268. Slots 306 end prior to front end 272 of front portion 268. Front portion 268 connects with rear portion 270 at step 308. Front end 272 may have a forward facing tapered surface 310 extending to flange 312. Step 308 may have a rearward facing tapered surface 314. Rearward facing tapered surface 314 may be disposed against tapered surface 263 of first end 256 of compression ring 210. Flange 312 and step 308 may form channel 316. Fingers 304 may have inwardly facing barbs 318. Wall 300 has an inner surface 319 with inward projections 320.

Figure 5:
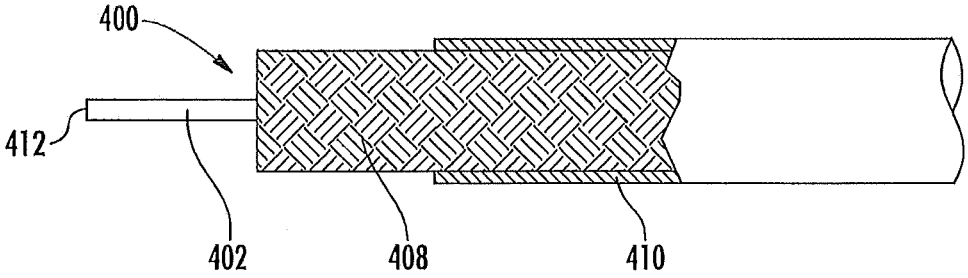
FIG. 5 is a partial cross sectional view of a coaxial cable with the end prepared.

Body 204, coupler 202, ferrule 208, back nut 502 and compression ring 210, may be made of metal such as, without limitation, brass and preferably plated with a conductive material such as nickel-tin. Shell 212 and gripping member 504 may be made of plastic such as, without limitation, acetal. Retaining ring 216 may be made from a brass alloy such as ECO Brass and may or may not be plated or coated. Insulator 220 is preferably made of plastic such as, without limitation, polymethylpentene also known as TPX® Polymethylpentene available from Mitsui Chemicals America, Inc., Rye Brook, N.Y. Contact 206 is preferably made of a copper alloy such as beryllium copper and preferably plated with a conductive material such as nickel-tin FIG. 5 illustrates coaxial cable 400 in a prepared state for use with coaxial cable connector 200. Coaxial cable 400 is substantially like coaxial cable 100 noted above. However, it is different as to how the cable end is prepared for use. As illustrated in FIG. 5, coaxial cable 400 has center conductor 402 that is surrounded by dielectric layer 404. Coaxial cable 400 has braided outer conductor 408 which is covered and protected by jacket 410. In FIG. 5, dielectric layer 404 is not visible as it may be cut flush with, and, thereby, covered by, braided outer conductor 408. Dielectric layer (or dielectric) 404 may also have foil or other metallic covering (also covered by braided outer conductor 408). From the end 412 of coaxial cable 400, center conductor 402 is exposed by removing dielectric layer 404, foil or other metallic covering, braided outer conductor 408, and jacket 410. A second portion of the coaxial cable 400 then has only jacket 410 removed, leaving dielectric layer 404, foil or other metallic covering and braided outer conductor 408 intact. As will be appreciated by those skilled in the art, however, due to the distinctive features of connector 200, as discussed herein, braided outer conductor 408 of coaxial cable 400 does not have to be folded back over jacket 410, resulting in less time than other methods of preparation.

Figure 6:
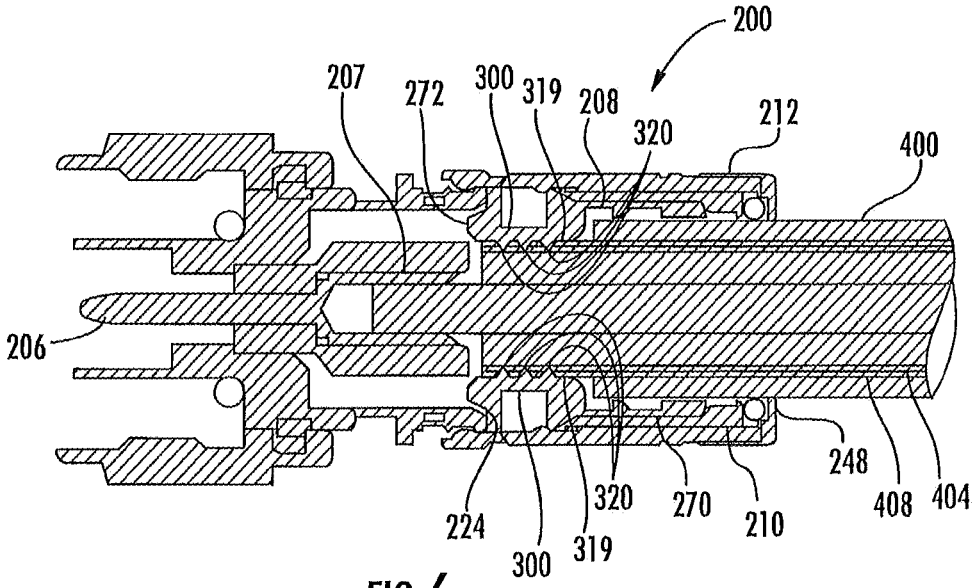
FIG. 6 is a cross sectional view of the coaxial cable connector of FIGS. 2 and 3 in an un-compressed or open condition with the prepared coaxial cable of FIG. 5 inserted therein.

The assembly of coaxial cable connector 200 will now be discussed with reference to FIGS. 6 and 7. As can be seen in FIG. 6, prepared coaxial cable 400 is inserted through opening 248 of shell 212, through rear portion 270 of ferrule 208, and, therefore, through compression ring 210. Dielectric 404 and outer conductor 408 terminate at rear end 224 of body 204 at inner surface 319 of wall 300. Inner conductor 402 extends through and beyond front end 272 of ferrule 208 into contact 206 and is retained by attachment portion 207 of contact 206. In this way, electrical and mechanical continuity and connection is established between contact 206 and inner conductor 402.

Figure 7:
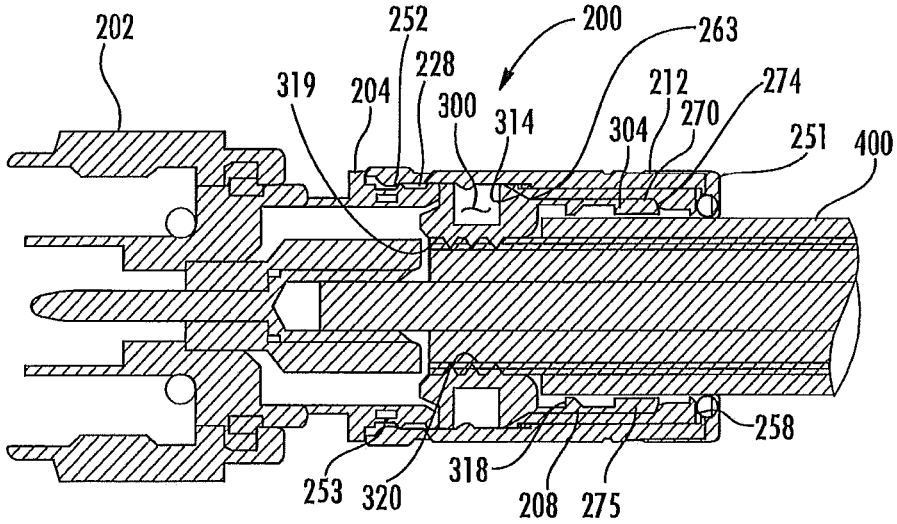
FIG. 7 is a cross sectional view of the coaxial cable connector of FIGS. 2 and 3 and the prepared coaxial cable of FIG. 5 inserted therein with the coaxial cable connector fully engaged with the coaxial cable.

FIG. 7 illustrates the coaxial cable connector 200 in fully engaged stage. After the coaxial cable 400 is inserted into the coaxial cable connector 200 as described above with reference to FIG. 6, the rear end 251 of the shell 212 is slidingly advanced over outer surface of body 204 toward coupler 202. The annular ring 252 of the shell 212 engages the retaining groove 253 of body 204 and prevents the backward movement of the shell 204 relative to the body 202. Shell 204 engages the compression ring 210 causing the tapered surface 264 proximate back end 258 of compression ring 210 to engage tapered surface 275 of rear end 274 of ferrule 208. The force of tapered surface 264 on tapered surface 275 drives the rear portion 270 of ferrule 208 inwardly causing fingers 304 to flex inwardly toward coaxial cable 400 forcing barbs 318 against jacket 410. Similarly, tapered surface 263 of first end 256 of compression ring 210 is forced against rearward facing tapered surface 314 of ferrule 208 providing a biasing force causing inward projections 320 of inner surface 319 of wall 300 to bite into coaxial cable 400 and, particularly, outer conductor 408. This may also cause inward projections 320 to bite into dielectric 404 underneath outer conductor 408. In this manner, barbs 318 and inner projections 320 retain coaxial cable 400 in the proper position in the coaxial cable connector 200. This also provides for appropriate pull strength for the coaxial cable 400.

Figure 8:
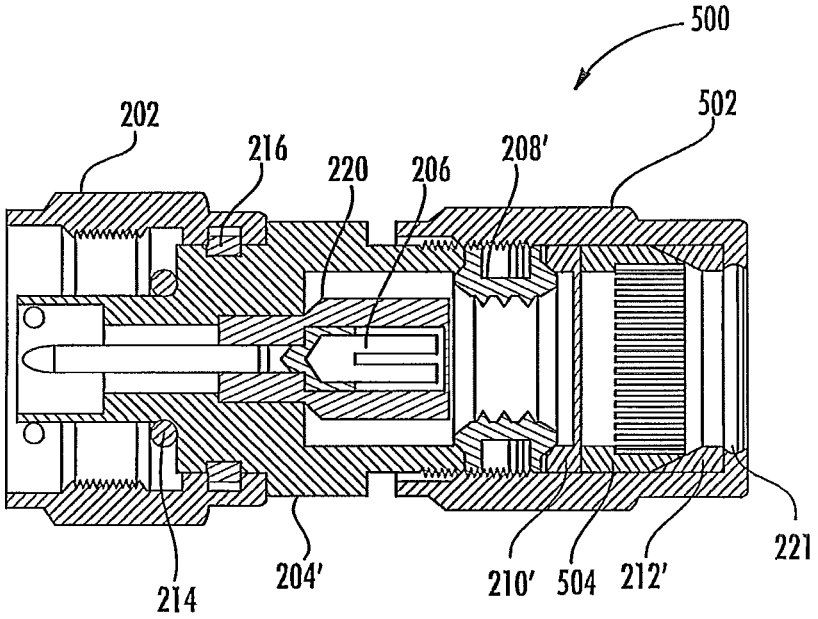
FIG. 8 is a cross sectional view of an exemplary embodiment of a coaxial cable connector.

Referring now to FIG. 8 an exemplary embodiment of coaxial cable connector 500 is illustrated. Wherever possible, the same numbers for the same components as used for coaxial cable connector 200, will be used to describe coaxial cable connector 500. Additionally, components with the same or same or similar function as in coaxial cable connector 200 may not be described again with respect to coaxial cable connector 500. Coaxial cable connector 500 includes O-ring 214, O-ring 221, body 204', coupler 202, retaining ring 216, insulator 220, contact 206, slotted ferrule 208', back nut 502, shell 212', gripping member 504, and compression ring 210'. Coupler 202 is rotatably attached to body 204' by means of retaining ring 216. Back nut 502 contains O-ring 221, shell 212', gripping member 504, compression ring 210' and ferrule 208'. Back nut 502 is threadedly attached to body 204' or, alternatively may be slideably press fit with body 204'. Insulator 220 is press or friction fit within body 204' and houses contact 206 by means of a barbed attachment feature. Body 204', coupler 202, ferrule 208, back nut 502 and compression ring 210' may be made of metal such as, without limitation, brass and preferably plated with a conductive material such as nickel-tin. Shell 212' and gripping member 504 may be made of plastic such as, without limitation, acetal. Retaining ring 216 may be made from a brass alloy such as ECO Brass and may or may not be plated or coated. Insulator 220 is preferably made of plastic such as, without limitation, polymethylpentene. Contact 206 is preferably made of a copper alloy such as beryllium copper and preferably plated with a conductive material such as nickel-tin.

Figure 9:
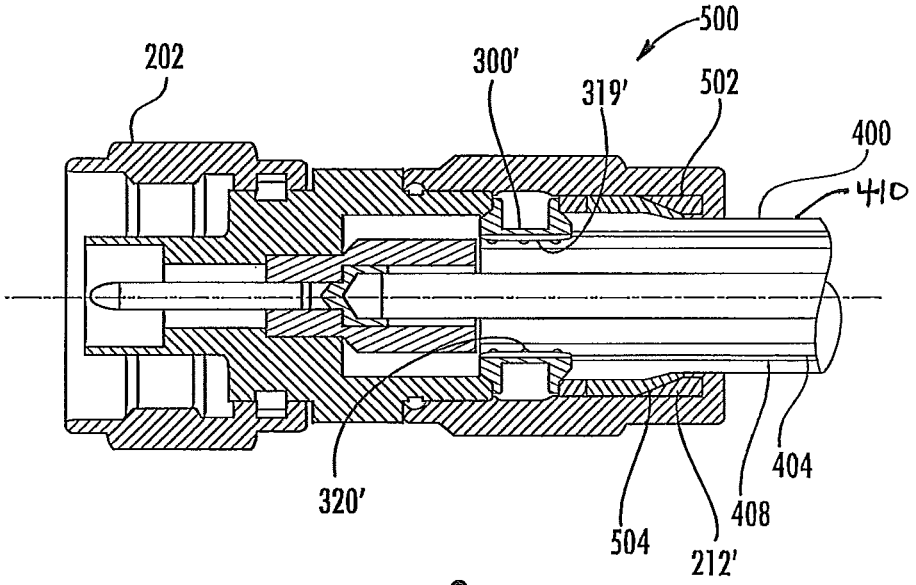
FIG. 9 is a cross sectional view of the coaxial cable connector of FIG. 8 and the prepared coaxial cable of FIG. 5 inserted therein with the coaxial cable connector fully engaged with the coaxial cable.

FIG. 9 illustrates coaxial cable connector 500 in fully engaged stage. Coaxial cable 400 is inserted into coaxial cable connector 500 in the same manner as described above for coaxial cable connector 200 with reference to FIG. 6. After coaxial cable 400 is inserted into coaxial cable connector 500, back nut 502 is advanced toward coupler 202. Advancing the back nut forces shell 212' against gripping member 504, which forces gripping member 504 against compression ring 210' causing gripping member 504 to deform towards coaxial cable 400 pressing against jacket 410. This action also forces compression ring 210' against ferrule 208' in the same manner as described above with respect to the front portion 268 of ferrule 208 with reference to FIG. 7 providing a biasing force causing inward projections 320' of inner surface 319' of wall 300' to bite into coaxial cable 400 and, particularly, outer conductor 408, which may also cause inward projections 320' to bite into dielectric 404 underneath outer conductor 408. In this manner, gripping member 504 and inner projections 320' retain coaxial cable 400 in the proper position in the coaxial cable connector 200 and provide for appropriate pull strength for the coaxial cable 400.

Figure 10:
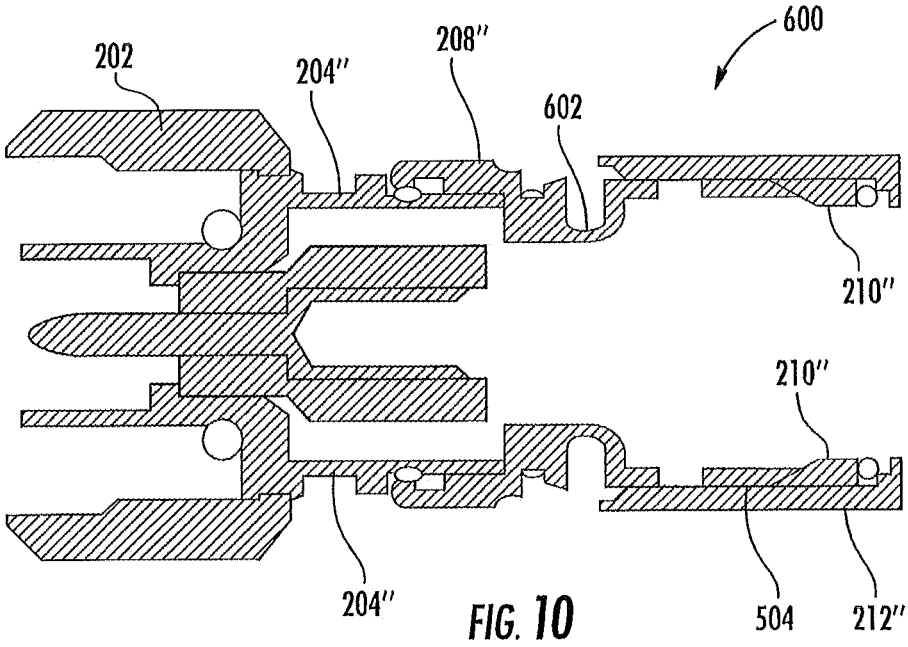
FIG. 10 is a cross sectional view of an exemplary embodiment of a coaxial cable connector.
Figure 11:
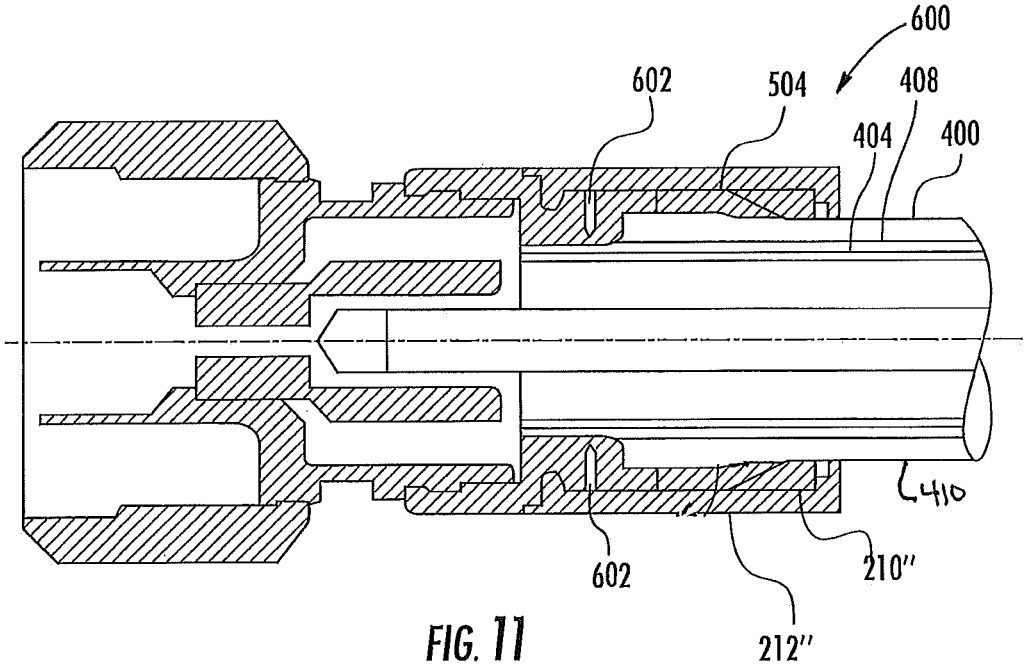
FIG. 11 is a cross sectional view of the coaxial cable connector of FIG. 10 and the prepared coaxial cable of FIG. 5 inserted therein with the coaxial cable connector fully engaged with the coaxial cable.

Referring now to FIGS. 10 and 11, there is illustrated an exemplary embodiment of coaxial cable connector 600. FIG. 10 illustrates coaxial cable connector 600 in an unengaged state, while FIG. 11 illustrates coaxial cable connector 600 with coaxial cable 400 inserted therein and with the coaxial cable connector 600 in a fully engaged stage. Wherever possible, the same numbers for the same components as used for coaxial cable connectors 200 and 500, will be used to describe coaxial cable connector 600. Additionally, components with the same or same or similar function as in coaxial cable connector 200 and 500 may not be described again with respect to coaxial cable connector 600. Ferrule 208" is disposed against body 204" and has a collapsible groove 602. As shell 212" is advanced toward coupler 202, shell 212" engages compression ring 210". Shell 212" forces compression ring 210" against gripping member 504 causing gripping member 504 to deform towards coaxial cable 400 pressing against jacket 410 in the same manner as described above with respect to FIG. 9. Additionally, compression ring 210" forces gripping member 504 against ferrule 208" and, thereby, forces ferrule 208" against body 204", causing collapsible groove 602 to collapse driving a portion of ferrule 208" radially inward to engage coaxial cable 400 and, in particular, outer conductor 408. Ferrule 208" may also engage dielectric 404 underneath outer conductor 408. Engagement of ferrule 208" with the coaxial cable 400 provides appropriate pull strength for the coaxial cable 400.

Many modifications and other embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims.

It is intended that the embodiments cover the modifications and variations of the embodiments provided they come within the scope of the appended claims and their equivalents. Although specific terms are employed herein, they are used in a generic and descriptive sense only and not for purposes of limitation.

We claim:

1. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the coaxial cable connector comprising:

a coupler;

a body having an internal surface extending between front and rear ends of the body, the internal surface defining a longitudinal opening, wherein the body rotatably attaches to the coupler;

a shell having an outer surface and an internal surface, the internal surface defining an opening through the shell, wherein the internal surface slidingly engages at least a portion of the rear end of the body;

a compression ring disposed within the shell, the compression ring including a first forward-facing tapered surface and a second forward-facing tapered surface axially offset from the first forward-facing tapered surface; and a ferrule disposed adjacent to the body and having a first rearward-facing tapered surface, a second rearward-facing tapered surface axially offset from the first rearward-facing tapered surface, and at least one finger with an inwardly directed engagement feature, wherein advancing the shell toward the coupler causes the first forward-facing tapered surface to engage the first rearward-facing tapered surface, and the second forward-facing tapered surface to engage the second rearward-facing tapered surface, such that the ferrule retains a coaxial cable inserted into the coaxial cable connector.

2. The coaxial cable connector of claim 1, wherein the ferrule has a front end, a back end, a front portion and a back portion.

3. The coaxial cable connector of claim 2, wherein the at least one finger comprises a plurality of fingers.

4. The coaxial cable connector of claim 3, wherein the plurality of fingers extend circumferentially around the rear portion of the ferrule.

5. The coaxial cable connector of claim 4, wherein the plurality of fingers are defined by longitudinal slots extending from the rear end through the rear portion and at least partially into the front portion.

6. The coaxial cable connector of claim 4, further comprising a compression ring disposed within the shell and engaging the rear end of the ferrule.

7. The coaxial cable of claim 6, wherein advancing the shell causes the compression ring to drive the rear portion of the ferrule inwardly, which causes the plurality of fingers to flex inwardly toward the coaxial cable forcing the engagement features against the coaxial cable.

8. The coaxial cable of claim 7, wherein the engagement features are forced against at least one of the outer conductor and the dielectric of the coaxial cable.

9. The coaxial cable connector of claim 3, wherein the front portion of the ferrule comprises a channel, and wherein the channel has a wall with an inwardly facing surface having inward projections.

10. The coaxial cable connector of claim 9, further comprising a compression ring disposed within the shell and engaging the channel of the ferrule.

11. The coaxial cable connector of claim 10, wherein the advancing the shell causes the compression ring to provide a biasing force against the channel forcing the inner projections of the inwardly facing surface of the wall to bite into the coaxial cable.

12. The coaxial cable of claim 11, wherein the inner projections bite into at least one of the outer conductor and the dielectric of the coaxial cable.

13. The coaxial cable connector of claim 1, further comprising a contact having an attachment portion, wherein the attachment portion is adapted to retain, be mechanically connected to, and be electrically continuous with the inner conductor of the coaxial cable.

14. The coaxial cable connector of claim 13, further comprising an insulator positioned around the contact.

15. The coaxial cable connector of claim 14, wherein the insulator friction fits in the body against the internal surface.

16. The coaxial cable connector of claim 1, further comprising a retainer, wherein the retainer seats in a retainer channel in the body.

17. The coaxial cable connector of claim 16, wherein the retainer provides a biasing force to attach the body to the coupler.

18. The coaxial cable connector of claim 1, wherein the engagement features are barbs.

19. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the coaxial cable connector comprising:

a coupler;

a body having an internal surface extending between front and rear ends of the body, the internal surface defining a longitudinal opening, wherein the body rotatably attaches to the coupler;

a shell having an outer surface and an internal surface, the internal surface defining an opening through the shell, wherein the internal surface slidingly engages at least a portion of the rear end of the body;

a ferrule disposed adjacent to the body and having a plurality of fingers with inwardly directed engagement features and a channel with a wall having an inwardly facing surface with inner projections; and a compression ring disposed within the shell and engaging the rear end of the ferrule, the compression ring having an internal surface, wherein advancing the shell toward the coupler causes the compression ring to drive the rear portion of the ferrule inwardly, which causes the plurality of fingers to flex inwardly toward the coaxial cable forcing the engagement features against the coaxial cable, and wherein advancing the shell causes the compression ring to provide a biasing force against the channel forcing the inner projections of the inwardly facing surface of the wall to bite into the coaxial cable.

20. The coaxial cable connector of claim 19, further comprising a retainer, wherein the retainer seats in a retainer channel in the body, and wherein the retainer provides a biasing force to attach the body to the coupler allowing the coupler to rotate with respect to the body.

21. The coaxial cable connector of claim 19, further comprising a contact having an attachment portion, wherein the attachment portion is adapted to retain, be mechanically connected to, and be electrically continuous with the inner conductor of the coaxial cable.

22. The coaxial cable connector of claim 21, further comprising an insulator, wherein the insulator positions around the contact, and wherein the insulator friction fits within the body against the internal surface.

23. The coaxial cable connector of claim 19, wherein the engagement features are barbs.

* * * * *